US006371245B1

(12) United States Patent
Diana

(10) Patent No.: US 6,371,245 B1
(45) Date of Patent: Apr. 16, 2002

(54) CLAMP FOR SCAFFOLDING PLANKS AND METHOD

(76) Inventor: Flavio Luciano Diana, 30 Scott Edward Drive, Lower Sackville, Nova Scotia (CA), B4C 3C7

( * ) Notice: Subject to any disclaimer, the term of this patent is extended or adjusted under 35 U.S.C. 154(b) by 0 days.

(21) Appl. No.: 09/559,922

(22) Filed: Apr. 27, 2000

(51) Int. Cl.[7] ..... E04G 1/00; A47B 96/06
(52) U.S. Cl. ..... 182/119; 248/228.6
(58) Field of Search ..... 182/119, 113, 182/222; 248/228.6, 231.71

(56) References Cited

U.S. PATENT DOCUMENTS

| | | | | |
|---|---|---|---|---|
| 376,304 A | | 1/1888 | Hawley | |
| 1,412,961 A | * | 4/1922 | Periolat | 248/231.71 X |
| 1,598,417 A | | 8/1926 | Babitt | |
| 1,794,976 A | * | 3/1931 | Mueller | 248/231.71 X |
| 2,569,450 A | | 10/1951 | Bouton | |
| 2,928,443 A | | 3/1960 | Sevachko | |
| 3,333,807 A | * | 8/1967 | Locatelli | 284/231.71 X |
| 3,854,552 A | | 12/1974 | Kensrue | |
| 3,957,240 A | | 5/1976 | Johansson | |
| 3,997,152 A | | 12/1976 | Sass et al. | |
| 4,187,929 A | * | 2/1980 | Cyr | 182/222 |
| 4,534,448 A | | 8/1985 | Trainer | |
| 5,918,843 A | * | 7/1999 | Stammers | 248/231.71 X |

FOREIGN PATENT DOCUMENTS

| | | | | |
|---|---|---|---|---|
| AU | 471883 | * | 7/1997 | 182/222 |

* cited by examiner

*Primary Examiner*—Daniel P. Stodola
*Assistant Examiner*—Hugh B. Thompson
(74) *Attorney, Agent, or Firm*—Bachman & LaPointe, P.C.

(57) ABSTRACT

A clamp for securing wood planks in side-by-side relationship when supported on a scaffolding structure, has a recess which receives the planks in such side-by-side relationship; the clamp securely engages outer side walls of a plurality of wood planks in the side-by-side relationship, with the upper faces of the planks above the recess such that an uninterrupted platform upper surface is formed by the upper faces of the planks.

23 Claims, 4 Drawing Sheets

CLAMP FOR SCAFFOLDING PLANKS AND METHOD

BACKGROUND OF THE INVENTION i) Field of the Invention

This invention relates to a clamp for securing wood planks in side-by-side relationship, to a scaffold assembly and to a method of forming a platform assembly.

ii) Description of Prior Art

Scaffold structures are employed to support working platforms for construction workers during the repair and construction of buildings. The platforms are formed by positioning wood planks in side-by-side relationship across horizontal support members of the scaffold structure. Several different working platforms may be supported by the scaffold structure, at the same or different elevations to provide access to different work site on the building under construction or repair.

The wood planks are typically 12 or 14 feet in length, 2 inches thick and 8, 10 or 12 inches wide. After positioning the planks in side-by-side relationship on the scaffolding structure, it is generally preferred to secure them together to provide stability in the platform assembly and for greater security for the construction worker.

A common practice in providing such stability and security is to affix a wooden cleat transversely of the adjacent planks; typically the wooden cleat is affixed by nailing it to the planks. If the wooden cleat is affixed to the planks across their upper surfaces, which are the more accessible surfaces, it presents a hazard to a construction worker on the platform assembly, since it forms a trip or obstacle interrupting the otherwise generally flat upper platform surface. Consequently, it is preferred to affix the cleat across the under surfaces of the positioned planks; however, the under surfaces are less accessible, necessitate the existence of a lower working platform or site, and also require that the nailing be in an upward direction which necessitates a sufficient load on the platform to hold the planks in position during the nailing operation. This may mean that a second construction worker stands or sits on he unsecured platform planks while a first construction worker carries out the nailing operation below the positioned planks.

It is impractical to carry out the nailing operation, in forming the platform assembly, at ground level, since the resulting platform assembly is then too heavy to lift and position on the scaffolding structure.

When the construction or repair is complete and the scaffold structure is disassembled it is necessary to remove the nails affixing the wooden cleat to the planks, before the planks can be lowered to ground level.

The nailing and nail removing operations are time consuming and various proposals have been made for mechanical clamps to replace the nailing. These mechanical clamps, however, are typically of fairly complex structure and components of the clamp form an obstacle or trip on the upper platform surface, creating a hazard. These clamps have not enjoyed commercial acceptance.

Typical prior proposals for clamps for platform assemblies are shown in U.S. Pat. No. 2,569,450—Bouton; U.S. Pat. No. 2,928,443—Sevachko; U.S. Pat. No. 4,187,929—Cyr and U.S. Pat. No. 4,534,448—Turner. Each of these prior clamps has a clamp component which extends across the upper surfaces of the plank assembly, thereby creating a tripping hazard, as well as a clamp component across the under surfaces of the plank assembly.

SUMMARY OF THE INVENTION

It is an object of this invention to provide a clamp for scaffolding planks of simple structure which can be readily applied to and removed from a platform assembly supported by a scaffolding structure.

It is a further object of this invention to provide a clamp for scaffolding planks which holds the planks securely in side-by-side relationship with the outermost faces, especially the upper faces, of the planks unobstructed by the component parts of the clamp; in the case where the upper surfaces are unobstructed, an uninterrupted platform surface is thereby formed from the upper faces of the planks.

It is another object of the invention to provide a scaffold assembly employing a clamp or clamps to secure a platform assembly or assemblies supported by a scaffolding structure, such that the upper surface of the platform assembly or assemblies may be uninterrupted by the clamp or clamps.

It is yet another object of this invention to provide a method of forming a platform assembly supported on a scaffolding structure in which the planks of the platform assembly are securely held in side-by-side relationship with a clamp such that an uninterrupted platform upper surface may be formed.

In accordance with one aspect of the invention there is provided a clamp for securing together a plurality of wood planks in side-by-side relationship to form a platform comprising: a clamp body having a recess defined therein adapted to receive a plurality of wood planks to form an assembly of the planks in side-by-side relationship with the upper faces of the planks disposed such that an uninterrupted platform upper surface is formed by the upper faces; and first and second plank engaging means extending inwardly of said body into said recess, and adapted to securely engage outer side walls of the assembly.

In accordance with another aspect of the invention there is provided a scaffold assembly comprising: a scaffolding structure and at least one platform assembly supported on said scaffolding structure, said platform assembly comprising a plurality of wood planks in side-by-side relationship, and secured in said relationship by at least one clamp, said planks being received in a recess of said clamp, said clamp securely engaging opposed outer side walls of said plurality of wood planks with the upper faces of said planks disposed such that an uninterrupted platform upper surface is formed by the upper faces of the planks engaged by the clamp.

In accordance with yet another aspect of the invention there is provided in a method of forming a platform assembly supported on a scaffolding structure to provide a working platform in which wood planks are positioned in side-by-side relationship and secured together as a platform assembly by a clamp, the improvement wherein the planks of the platform assembly are received in a recess of said clamp and said clamp securely engages opposed side walls of the platform assembly with the upper faces of the planks disposed such that an uninterrupted platform upper surface is formed by the upper faces of the planks engaged by the clamp.

In still another aspect of the invention there is provided a clamp for securing together a plurality of wood planks in side-by-side relationship to form a platform comprising: a clamp body having a recess defined therein adapted to receive a plurality of wood planks to form an assembly of the planks in side-by-side relationship, such that a platform is formed by said planks; and first and second plank engaging means extending inwardly of said body into said recess, said first and second engaging means each comprising wood penetrating members adapted to penetrate the outer side walls of the assembly.

DESCRIPTION OF PREFERRED EMBODIMENTS

In a specific embodiment of the invention, a clamp for securing together a plurality of wood planks in side-by-side relationship to form a platform comprises an elongate bar having opposed first and second end flanges extending from opposed first and second ends of the bar.

A recess is defined between the end flanges and the bar, the recess being adapted to receive a plurality of wood planks to form the assembly of planks in side-by-side relationship with the upper faces of the planks disposed such that an uninterrupted platform upper surface is formed by the upper faces of the planks.

First and second plank engaging means extending inwardly of the first and second flanges, respectively, into the recess for securely engaging outer side walls of the assembly of wood planks.

The clamp of the invention preferably has opposed wood penetrating members which penetrate the wood planks at opposed sides of the assembly of wood planks in their side-by-side relationship. Suitably at least one of the plank engaging means is moveable inwardly and outwardly of the recess for penetrating engagement of the wood planks received in the recess of the clamp, by the wood penetrating members.

In one embodiment the moveable plank engaging means comprise a rotatable screw supporting an abutment member, for example, an abutment plate, adjacent but spaced apart from a wood penetrating end of the screw. This arrangement is somewhat similar to the screw jack except that the screw extends beyond the abutment plate to terminate in the wood penetrating end.

A second plank engaging means may comprise one or more stationary wood penetrating spikes extending inwardly from a flange of the clamp.

A scaffold assembly of the invention may include a plurality of the clamps in spaced apart relationship along the underside of the assembly of planks in order to better secure the assembly. In general, it is preferable to employ at least two spaced apart clamps, the clamps preferably being positioned at opposed ends of the elongate assembly of planks, however, a single clamp will also suffice for each assembly of planks forming a platform assembly.

Furthermore, the scaffold assembly may include a plurality of platform assemblies secured by means of the clamps of the invention. These platform assemblies may be at the same and at different elevations of the scaffolding structure to permit construction workers to work at different working sites. Suitably the different platform assemblies may be positioned relative to one another in the scaffolding structure, to permit a construction worker to move easily from one platform assembly to another.

The clamp may secure two or more planks in side-by-side relationship, however, in the simplest case the clamp secures two planks in side-by-side relationship and for most purposes this forms a platform of adequate width to provide a safe working platform.

Reference herein to an uninterrupted platform upper surface means that a component part or parts of the clamp do not lie on or extend over the upper faces of the planks such as would present an obstacle or potential trip on the platform upper surface, to a construction worker located on the platform.

In the most preferred embodiments of the invention the upper faces of the planks are disposed above the recess such that an uninterrupted platform upper surface is formed by the upper faces above the clamp.

In some less advantageous embodiments the end flanges and the abutment plate might extend to a height above the elongate bar greater than the thickness of the wood planks. In such case the end flanges and abutment plate may project above the side walls of the plank assembly, however, such projection does not interfere with the platform upper surface which remains uninterrupted.

Likewise where a handle is mounted on the outer end of the rotatable screw for ease in rotating the screw for advancement into the recess and withdrawal from the recess, the handle might extend to a height above the upper faces of the planks, however it will be remote from the upper platform surface and will not overlie or otherwise present an obstacle to a person working on the platform.

In general, it is advantageous and preferable to mount the clamp from the underside of the plank assembly such that the outermost faces of the planks are the upper faces of the plank assembly, and are uninterrupted by the clamp, In this way, an uninterrupted platform working surface is formed by the plank assembly, free of obstacles from the clamp.

On the other hand, the clamp will function to secure the assembly if mounted from the upper side of the plank assembly. In this case the outermost faces of the plank are the lower faces and the clamp body lies across the upper platform surface formed by the plank assembly.

The clamp may be brightly coloured and highly visible such that it is unlikely to prevent a serious obstacle to a worker on the platform, especially if it is located adjacent the scaffolding structure.

Some clamps may typically be employed to mount planks from the upper side, when planks overlap as is the case when an extended platform is produced in the longitudinal direction of the planks. In this case the ends of a first plank assembly may overlie the ends of a second longitudinally adjacent assembly, and it may be preferred to secure the ends of the underlying second assembly on the upper side of their planks adjacent the overlying ends of the first plank assembly.

DESCRIPTION OF PREFERRED EMBODIMENTS WITH REFERENCE TO THE DRAWINGS

Figure 1:
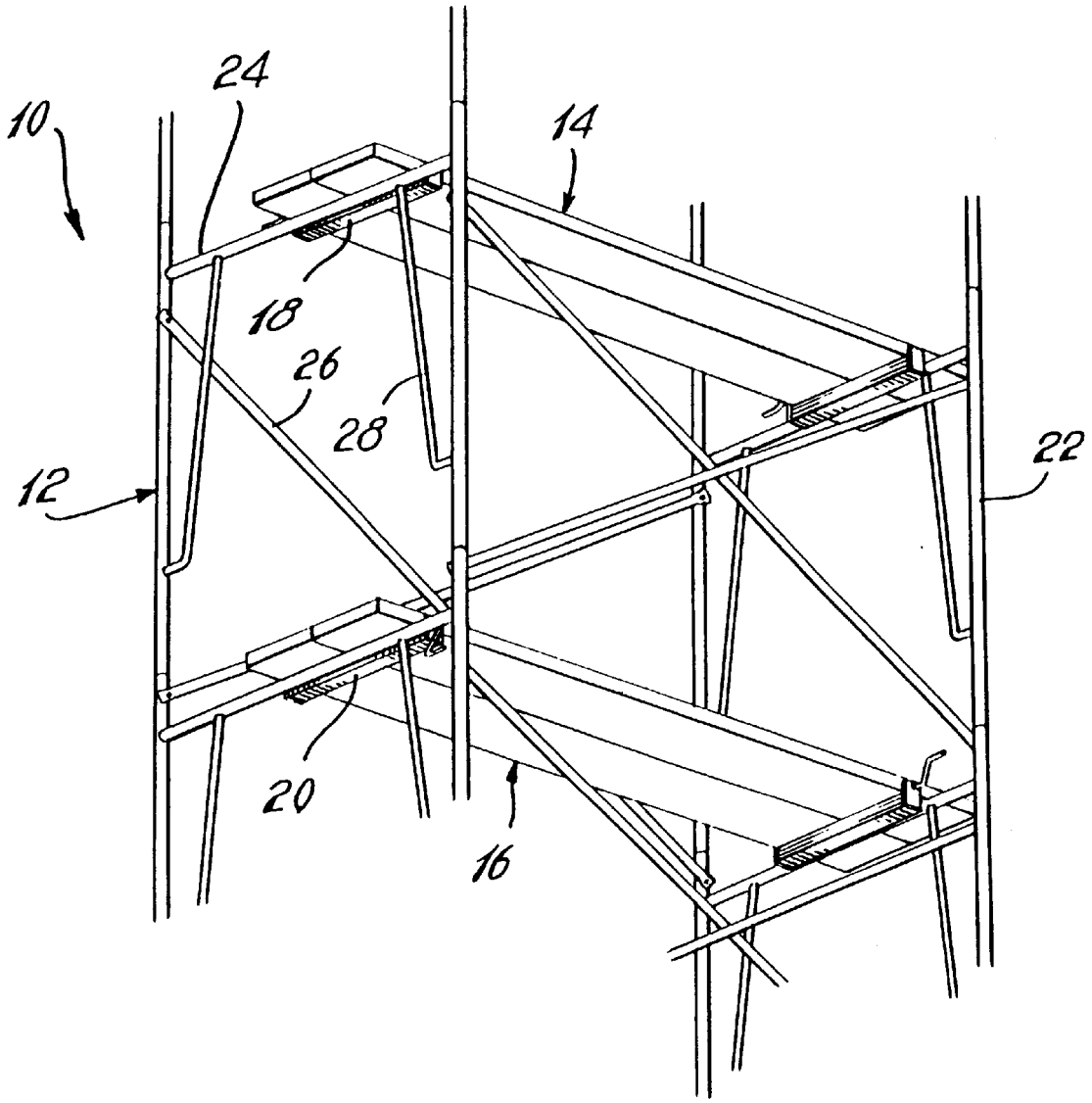
FIG. 1 is a schematic, fragmentary perspective view of a scaffold assembly of the invention in which platform assemblies are secured by clamps of the invention.

With further reference to FIG. 1, a scaffold assembly 10 comprises a scaffolding structure 12 and platform assemblies including platform assemblies 14 and 16.

Platform assembly 14 is secured by a clamp 18 and platform assembly 16 is secured by a clamp 20.

The scaffolding structure 12 comprises vertical members 22, horizontal members 24, diagonal members 26 and bracing members 28 which collaborate to form a firm structure, in conventional manner. The nature of the connections between the different members of the scaffolding structure is well known and is not the subject of the invention.

The platform assemblies including the platform assemblies 14 and 16 are supported on horizontal members 24 of the scaffolding structure 12.

Figure 2:
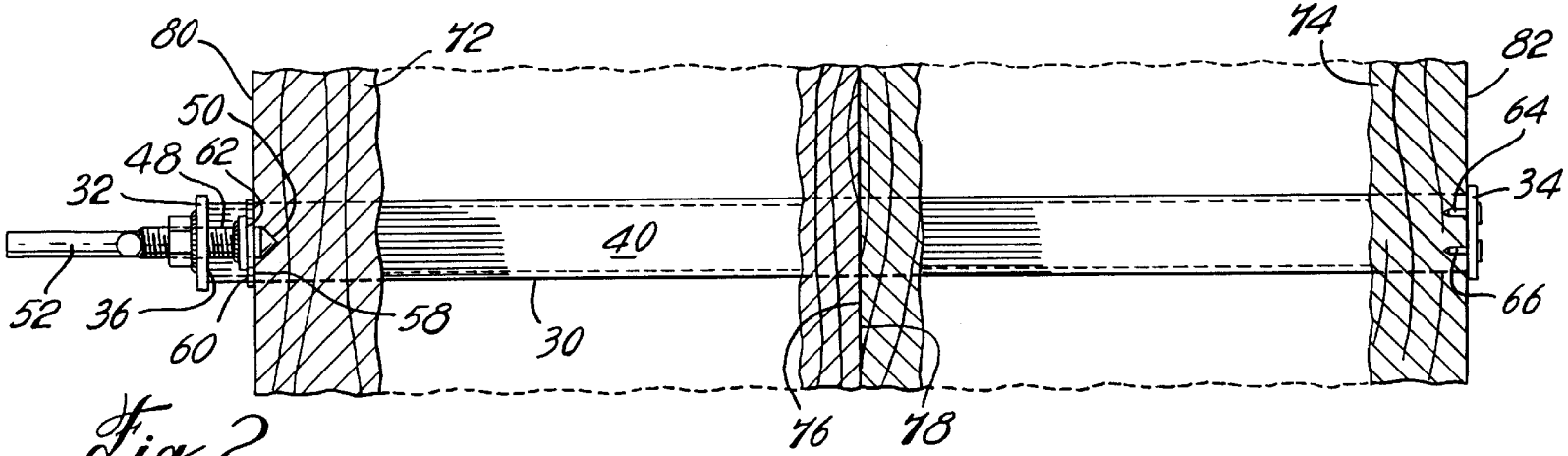
FIG. 2 is a top plan of the clamp of the invention with a partial view of an assembly of planks.
Figure 3:
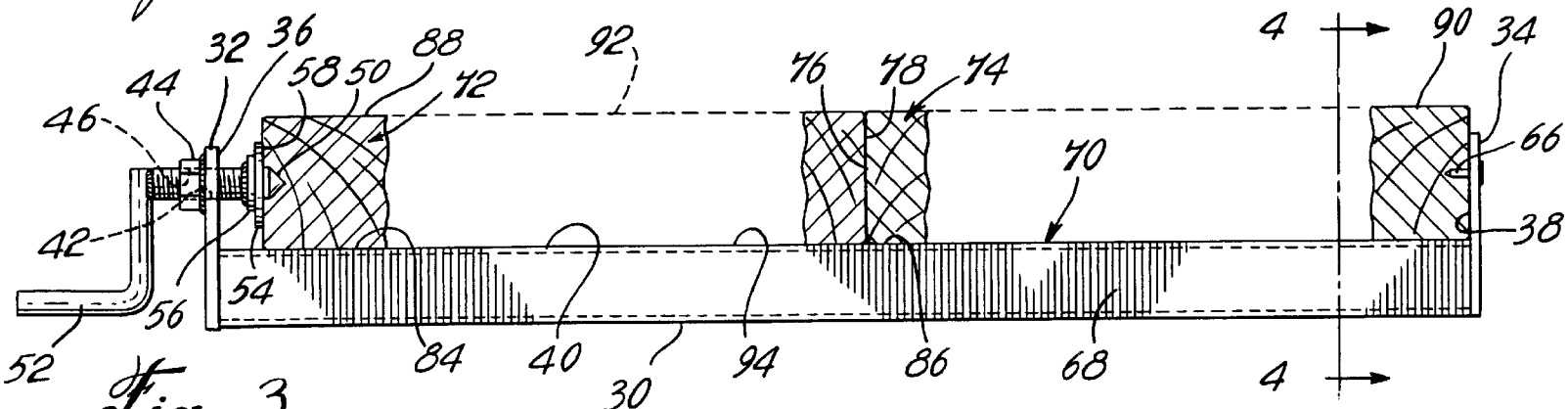
FIG. 3 is a front elevation of the clamp of FIG. 2 with a partial view of the assembly of planks.
Figure 4:
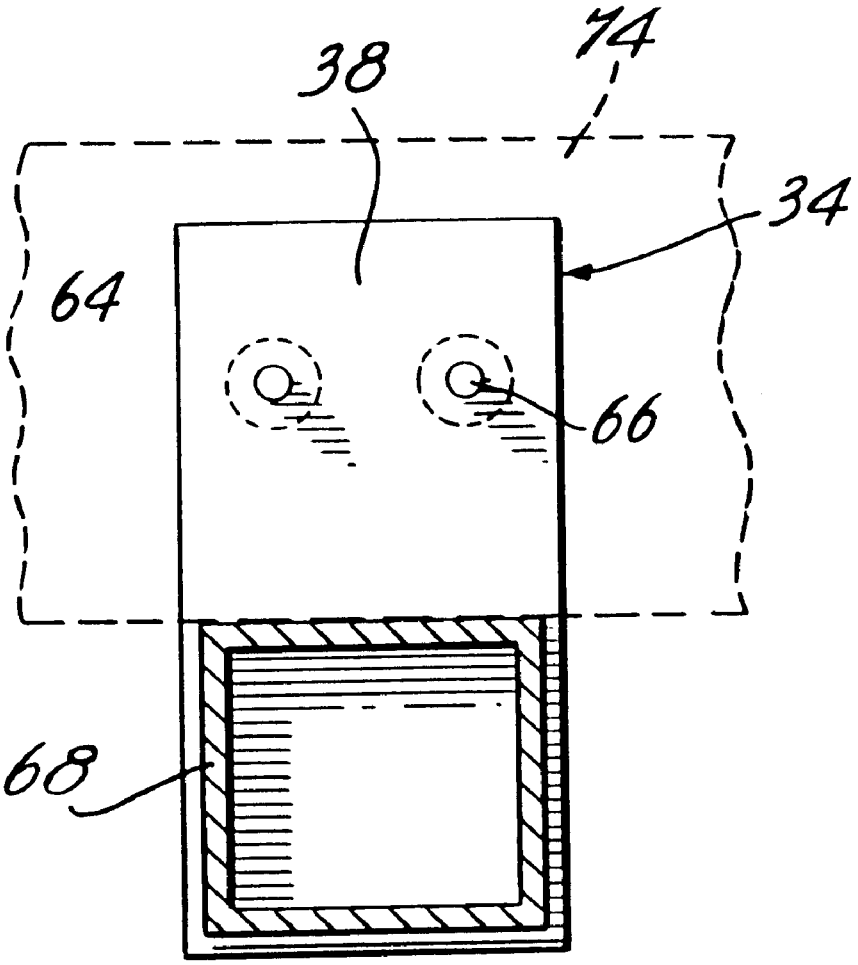
FIG. 4 is a cross-section on line 4—4 of FIG. 3 with a partial view of the planks.

With further reference to FIGS. 2, 3 and 4, clamp 18 comprises an elongate bar 30 and opposed end flanges 32 and 34. End flange 32 has a flat inner face 36 and end flange 34 has a flat inner face 38, the faces 36 and 38 being generally parallel and in opposed relationship.

Elongate bar 30 has a flat upper wall 40 and faces 36 and 38 extend generally perpendicularly of wall 40.

A bore 42 extends through end flange 32 and is aligned with a threaded bore 46 in a threaded nut 44 which is welded to end flange 32. A screw 48 is threaded mounted in threaded bore 46 and extends through bore 42. Screw 48 has a wood penetrating end 50 and a handle 52.

An abutment plate 54 is supported by support nut 56 on screw 48 such that abutment plate 54 is adjacent to but spaced from wood penetrating end 50. The abutment plate 54 is of disk-shape as illustrated but may be of any polygonal shape including triangular, rectangular and pentagonal.

Support nut 56 is threadedly mounted on and welded to screw 48 so that it rotates with screw 48. Abutment plate 54 has an exposed abutment face 58, and a face 60 opposed to abutment face 58 which face 60 is welded to all opposed face 62 of support nut 56. Thus, abutment plate 54 and support nut 56 rotate with screw 48.

A pair of spikes 64 and 66 extend inwardly of end flange 34. Spikes 64 and 66 are spaced apart and extend generally perpendicularly inwardly of the flat inner face 38 of end flange 34.

Abutment face 58 lies in a plane which is generally perpendicular to the flat upper wall 40 of elongate bar 30 and generally parallel to the flat inner faces 36 and 38 of end flanges 32 and 34, respectively.

Figure 5:
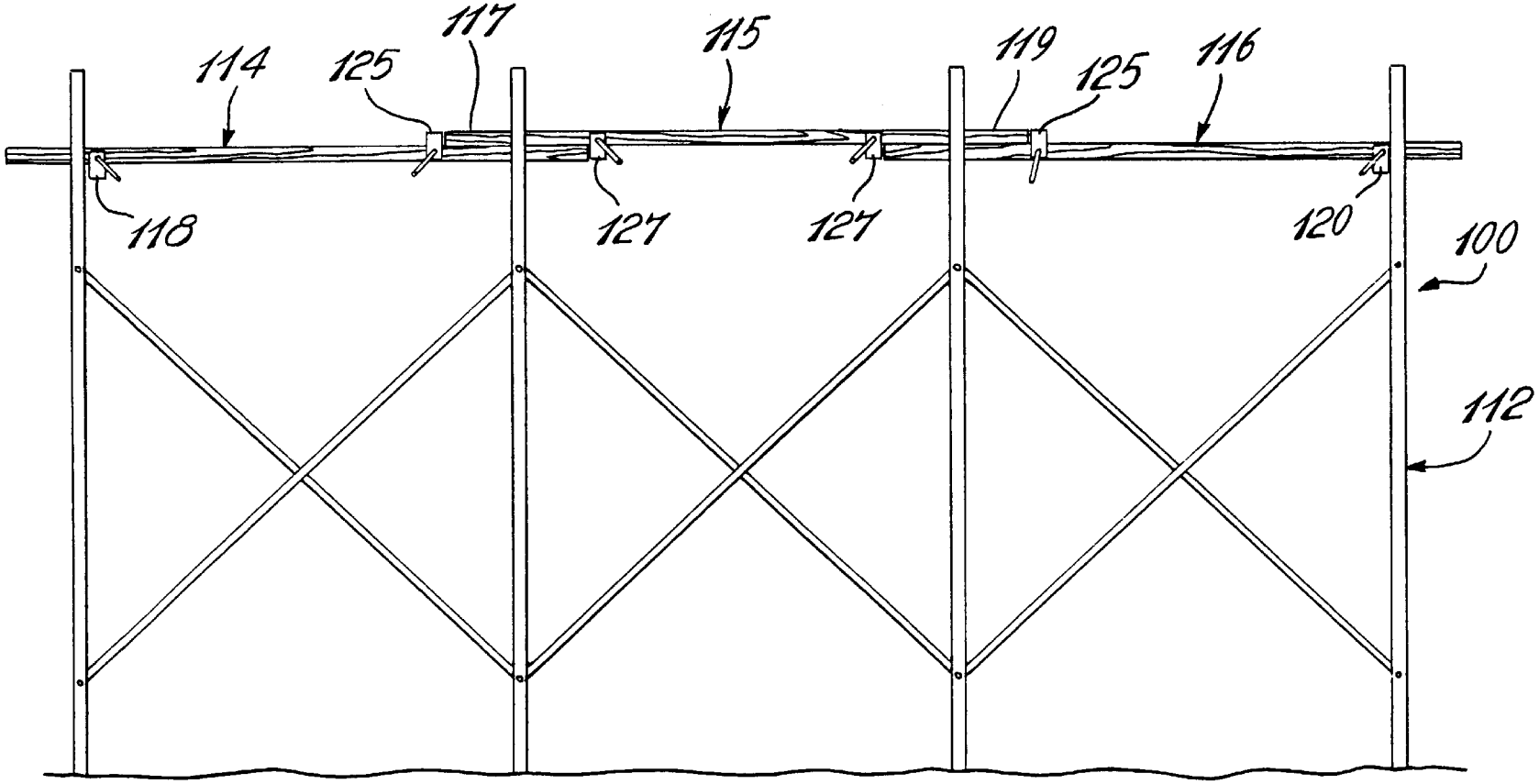
FIG. 5 is a schematic, front elevation of a scaffold assembly in which three platform assemblies extend longitudinally and partly overlapping.

As more particularly evident from FIG. 5, elongate bar 30 is defined by a tube 68 of rectangular cross-section.

A recess or slot 70 is defined in clamp 18 between the flat inner faces 36 and 38 of end flanges 32 and 34 respectively, and the flat upper wall 40 of elongate bar 30; and a variable slot 94 is defined within recess 70 between abutment face 58, flat inner face 38 of end flange 34, and flat upper wall 40 of elongate bar 30, With further reference, again, to FIG. 1 and also to FIGS. 2, 3 and 4, a platform assembly 14 comprises a pair of planks 72 and 74 in side-by-side relationship, in which an inner side wall 76 of plank 72 contacts an inner side wall 78 of plank 74, with the planks 72 and 74 received in recess 70 and slot 94 of clamp 18.

The outer side wall 80 of plank 72 is penetrated by wood penetrating end 50 of screw 48 with the abutment face 58 of abutment plate 54 abutting outer side wall 80. The spikes 64 and 66 penetrate outer side wall 82 of plank 74 and flat inner face 38 of end flap 34 abut the outer side wall 82.

It will be understood that the description hereinbefore of claim 18 applies equally to the other clamps employed in the assembly, including clamp 20. Likewise it will be understood that the description hereinbefore of platform assembly 14 applies equally to the other platform assemblies including platform assembly 16.

The reference herein to the inner faces 36 and 38 being generally perpendicular to flat upper wall 40, to the spikes 64 and 66 being generally perpendicular to flat inner face 38 and to the abutment face 58 being contained in a plane generally perpendicular to flat upper wall 40, and any other references herein to general perpendicularity, are to be understood as extending to structures in which parts or surfaces are truly perpendicular, or are, for all practical purposes, to be considered perpendicular, in that the deviation from actual perpendicularity does not substantially defeat the structural relationships requiring that the planks 72 and 74 be securely contained in recess 70 and slot With greater particularity, lower faces 84 and 86 of planks 72 and 74 respectively contact flat upper wall 40 of elongate bar 30, while the outer side walls 80 and 82 respectively contact abutment face 58 and flat inner face 38, respectively, whereby the planks 72 and 74 mate with slot 94 within recess 70, which slot 94 is defined between abutment face 58 and flat inner face 38 and flat upper wall 40.

In accordance with the invention in its more preferred embodiment, end flanges 32 and 34 extend a height above flat upper wall 40 of elongate bar 30 which is less than the thickness of planks 72 and 74 such that the upper faces 88 and 90 of planks 72 and 74, respectively, are disposed above recess 70. Likewise, abutment plate 54 and support nut 56 extend radially outwardly of screw 48 such that at their maximum height above screw 48, they are disposed below upper faces 88 and 90 of the planks 72 and 74, respectively. In this way, the upper faces 88 and 90 define an upper platform surface 92 which is uninterrupted by a part or component of the clamp 18, so that the clamp 18 does not present an obstacle or trip on the upper platform surface 92.

In use, the scaffolding structure 12 is first assembled in conventional manner as well known to persons in the art.

Individual planks such as 72 and 74 are then positioned across horizontal members 24 of the scaffolding structure at an elevation at which a platform assembly 14 is desired within the scaffolding structure 12. The planks 72 and 74 are positioned in side-by-side relationship and a clamp 18 is positioned below planks 72 and 74 with the lower faces 84 and 86 of the planks 72 and 74 contacting the flat upper wall 40 of the elongate bar 30 of clamp 18.

While holding the clamp 18 in this position, the screw 48 is rotated by means of handle 52 to advance wood penetrating end 50 and abutment plate 54 towards outer side walls 80 of plank 72, with the spikes 64 and 66 extending towards outer side wall 82 of plank 74. When the distance separating wood penetrating end 50 of screw 48 and the outer end of spikes 64 and 66 matches the width of the assembly 14 defined by the combined planks 72 and 74 in side-by-side relationship with inside walls 76 and 78 in contact, further advancement of screw 48 results in penetration of outer side wall 80 by wood penetrating end 50, and penetration of outer side wall 82 by spikes 64 and 66. Further rotation of screw 48 by handle 52 is continued until abutment face 58 of abutment plate 54 abuts outer side wall 80 such that wood penetrating end 50 penetrates plank 72 at its outer side wall 80 to its maximum extent, and preferably until the spikes 64 and 66, fully penetrate plank 76 at outer side wall 82 and flat inner face 38 of end flange 34 abuts the outer side wall 82 of plank 74.

In this configuration the planks 72 and 74 are securely held in side-by-side relationship in recess 70 and more especially within the adjustable slot 94 of recess 70. The upper faces 88 and 90 of the planks 72 and 74, as indicated above, are disposed above end flanges 32 and 34 and above abutment plate 54 and support nut 56 whereby the upper faces 88 and 90 form an upper platform surface which is uninterrupted and unobstructed by any part of the clamp 18.

The platform assembly 16 is constructed in similar manner with clamp 20 and a pair of planks similar to planks 72 and 74.

In this way a plurality of platform assemblies including the assemblies 14 and 16 can be formed within scaffolding structure 12 to provide platforms for the construction workers at different work sites at the same and different elevations of the scaffolding structure to provide access to different construction work sites.

When the scaffold assembly is to be disassembled at the completion of the construction operation, the clamps are removed by rotating screw 48 in the reverse direction by means of handle 52 whereby the distance separating wood penetrating end 50 and outer ends of spikes 64 and 66 expands or enlarges such that wood penetrating end 50 and spikes 64 and 66 are withdrawn from penetration of the wood planks 72 and 74 respectively, whereafter the clamp 18 and the individual planks 72 and 74 may be lowered to ground level and may then be stored for future use or transported to a new construction site.

The other platform assemblies including assembly 16 are disassembled in the same manner whereafter the scaffolding structure 12 is disassembled in conventional manner as will be understood by persons in the art.

It will be seen that the invention provides a clamp exemplified by clamp 18 of simple structure, which is readily employed to secure planks in side-by-side relationship, and can readily be disassembled from the planks. The mode of securement provided by the clamp of the invention avoids clamp parts or components extending across the upper faces of the planks, and indeed in the more preferred embodiments the components of the clamp are all, in use, disposed remote from the upper faces of the planks and do not contact or extend over the upper faces of the planks.

In the particular configuration of the handle 52 illustrated in FIG. 3, it can be envisaged that the handle 52 might extend to a height above the upper faces 88 and 90 of the planks 72 and 74, but such handle 52 does not extend across the upper faces 88 and 90 and indeed extends outwardly so that it does not, in any way, obstruct the platform surface 92.

With further reference to FIG. 5, a scaffold assembly 100 comprises a scaffolding structure 112 and platform assemblies 114, 115 and 116 extending longitudinally of the planks.

Platform assembly 115 has ends 117 and 119 which overlie the ends 121 and 123 of plank assemblies 114 and 116, respectively.

Clamp 118 secures assembly 114 from the underside at one end and clamp 120 secures assembly 116 from the underside at one end. Clamps 125, on the other hand, secure assemblies 114 and 116 from the upper side adjacent ends 117 and 119 of assembly 115 and thus above ends 121 and 123.

Clamps 127 secure the planks of assembly 115 from the underside.

Although clamps 125 extend above assemblies 114 and 116 they are adjacent to and slightly below assembly 115 and thus do not present an extra obstacle. Additionally clamps 125 on assemblies 114 and 116 act as stops to limit longitudinal movement of assembly 115 relative to assemblies 114 and 116.

It will be recognized that variations in the structure described and illustrated hereinbefore may be made without departing from the spirit of the invention and without avoiding the spirit of the claims hereinafter.

I claim:

1. A platform assembly comprising a plurality of wood planks in abutting side-by-side relationship and a clamp securing said plurality of wood planks in said side-by-side relationship to form a platform comprising:

a clamp body having a recess defined therein, a plurality of wood planks forming an assembly of the planks in side-by-side relationship secured in said recess, such that a platform is formed by said planks; and first and second opposed plank engaging means extending inwardly of said body into said recess, said first and second engaging means each comprising wood penetrating members penetrating outer side walls of the assembly of the planks.

2. A platform assembly according to claim 1, wherein at least one of said first and second plank engaging means is moveable inwardly and outwardly of said recess for penetrating engagement of the wood planks in the recess by the wood penetrating members.

3. A platform assembly according to claim 2, wherein said clamp body comprises an elongate bar having opposed first and second end flanges extending from opposed first and second ends of said bar, said recess being defined between said end flanges and said bar, said first and second plank engaging means extending inwardly of said first and second flanges, respectively, into said recess; and wherein said first plank engaging means comprises:

a rotatable screw having a wood penetrating end disposed inwardly of said first flange, in said recess, said rotatable screw being threadedly mounted at said first flange for threaded advancement and withdrawal of said wood penetrating end inwardly and outwardly of said recess, and an abutment member mounted on said screw adjacent said wood penetrating end, said abutment member being adapted to abut an outer side of a plank penetrated by said wood penetrating end.

4. A platform assembly according to claim 3, wherein said second plank engaging means comprises a pair of spaced apart, stationary wood penetrating spikes extending inwardly of said recess from said second flange.

5. A platform assembly according to claim 4, wherein said second flange has a generally flat inner face, and said abutment member has a generally flat abutment face, said abutment face being generally parallel to and in opposed facing relationship with said inner face of said second flange; and said spikes extend generally perpendicularly of said inner face of said second flange and said wood penetrating end extends generally perpendicularly of said abutment face.

6. A platform assembly according to claim 5, wherein said elongate bar has a generally flat inner face which abuts the lower faces of said plurality of planks; said inner face of said second flange being generally perpendicular to said inner face of said bar and said abutment face being in a plane generally perpendicular to said inner face of said bar.

7. A platform assembly according to claim 6, wherein said recess receives the assembly such that the outermost faces of the planks form a surface uninterrupted by the clamp.

8. A scaffold assembly comprising:

a scaffolding structure and at least one platform assembly supported on said scaffolding structure, said platform assembly comprising a plurality of wood planks in side-by-side relationship, and secured in said relationship by at least one clamp, said planks being received in a recess of said clamp, said clamp securely engaging opposed outer side walls of said plurality of wood planks with the upper faces of said planks disposed such that an uninterrupted platform upper surface is formed by the upper faces, wherein said at least one clamp comprises an elongate bar having opposed first and second end flanges extending from opposed first and second ends of said bar, said recess being defined between said end flanges and said bar, and first and second plank engaging means extending inwardly of said first and second flanges, respectively, into said recess, and having wood penetrating members in penetrating engagement with said outer side walls of said plurality of wood planks, said recess being configured such that the upper faces of the planks received in the recess, are above the recess and said first and second plank engaging means are adapted to securely engage said opposed outer side walls with the upper faces of the planks above the recess such that the uninterrupted platform surface is above the clamp.

9. A scaffold assembly according to claim 8, wherein said first plank engaging means comprises:

a rotatable screw having a wood penetrating end disposed inwardly of said first flange, in said recess, said rotatable screw being threadedly mounted at said first flange for threaded advancement and withdrawal of said wood penetrating end inwardly and outwardly of said recess, and an abutment member mounted on said screw adjacent said wood penetrating end, said abutment member abutting an outer side of a plank penetrated by said wood penetrating end;

and wherein said second plank engaging means comprises a pair of spaced apart, stationary wood penetrating spikes extending inwardly of said recess from said second flange;

said abutment member having a generally flat abutment face, said abutment face being generally parallel to and in opposed facing relationship with said inner face of said second flange.

10. A scaffold assembly according to claim 9, wherein said spikes extend generally perpendicularly of said inner face of said second flange and said wood penetrating end extends generally perpendicularly of said abutment face.

11. A scaffold assembly according to claim 9, wherein said clamp includes handle means mounted on said screw for rotating said screw in said threaded advancement and withdrawal; and said elongate bar comprises a tubular member of rectangular cross-section.

12. A scaffold assembly according to claim 8, wherein said at least one clamp comprises a plurality of clamps in spaced apart relationship.

13. A scaffold assembly according to claim 8, wherein said at least one platform assembly comprises a plurality of platform assemblies supported on said scaffolding structure.

14. A clamp for securing a plurality of wood planks in side-by-side relationship to form a platform comprising:

a clamp body comprising an elongate bar having a generally flat inner face and opposed first and second end flanges extending from opposed first and second ends of said elongate bar, a recess defined between said flat inner face of said elongate bar and said first and second flanges, said recess being adapted to receive a plurality of wood planks to form an assembly of the planks in side-by-side abutting relationship with the lower faces of the planks abutting the generally flat inner face of the clamp body, and the upper faces of the planks disposed such that an uninterrupted platform upper surface is formed by the upper faces, first plank engaging means extending inwardly of said first end flange, second plank engaging means comprising a wood penetrating member extending inwardly of said second end flange, said first plank engaging means comprising:

a rotatable screw having an inner wood penetrating end, said rotatable screw being threadedly mounted in said clamp body for threaded advancement and withdrawal of said wood penetrating end inwardly and outwardly of said recess, and an abutment member mounted on said screw in adjacent spaced apart relationship with said wood penetrating end and adapted to abut an outer side of a plank penetrated by said inner wood penetrating end, said first and second plank engaging means for penetrating outer side walls of the assembly of planks.

15. A clamp according to 14, wherein said recess is configured such that the upper faces of the planks received in the recess, are above the recess and said first and second plank engaging means are adapted to securely engage outer side walls of the assembly below the upper faces of the planks.

16. A clamp according to claim 14, including a handle mounted on said screw for rotating said screw in said threaded advancement and withdrawal.

17. A clamp according to claim 14, wherein said generally flat inner face of said clamp body has a length of at least 16 inches for abuttingly engaging at least two planks each having a width of at least 8 inches in side-by-side relationship, in said recess.

18. A clamp according to claim 14, wherein said second plank engaging means comprises a pair of spaced apart, stationary wood penetrating spikes extending inwardly of said recess from said second flange.

19. A clamp according to claim 18, wherein said second flange has a generally flat inner face, and said abutment member has a generally flat abutment face, said abutment face being generally parallel to and in opposed facing relationship with said inner face of said second flange.

20. A clamp according to claim 19, wherein said spikes extend generally perpendicularly of said inner face of said second flange and said wood penetrating end extends generally perpendicularly of said abutment face.

21. A clamp according to claim, 20, wherein said inner face of said second flange is generally perpendicular to said inner face of said bar and said abutment face is in a plane generally perpendicular to said generally flat inner face of said bar.

22. A clamp according to claim 21, wherein said elongate bar comprises a tubular member of rectangular cross-section.

23. In a method of forming a platform assembly supported on a scaffolding structure to provide a working platform in which wood planks are positioned in side-by-side relationship and secured together as the platform assembly by a clamp, the improvement wherein the planks of the platform assembly are received in a recess of said clamp and said clamp securely engages opposed side walls of the platform assembly with the upper faces of the planks disposed such that an uninterrupted platform upper surface is formed by the said upper faces, wherein said clamp comprises opposed wood penetrating members which penetrate the opposed side walls of the platform assembly to securely engage the assembly.

* * * * *